US008746953B1

(12) United States Patent
Shao

(10) Patent No.: US 8,746,953 B1
(45) Date of Patent: Jun. 10, 2014

(54) WATERPROOF DECORATIVE LAMP

(71) Applicant: Chiliang Shao, Dongguan (CN)

(72) Inventor: Chiliang Shao, Dongguan (CN)

( * ) Notice: Subject to any disclaimer, the term of this patent is extended or adjusted under 35 U.S.C. 154(b) by 0 days.

(21) Appl. No.: 13/729,971

(22) Filed: Dec. 28, 2012

(51) Int. Cl.
*H01R 33/00* (2006.01)

(52) U.S. Cl.
CPC ..... *H01R 33/00* (2013.01)
USPC ..... 362/651; 362/311.02

(58) Field of Classification Search
CPC ..... H01R 33/00
USPC ..... 362/651–653, 645, 654, 657–659, 375, 362/311.02
See application file for complete search history.

(56) References Cited

U.S. PATENT DOCUMENTS 6,120,312 A * 9/2000 Shu ..... 439/356
7,547,237 B1 * 6/2009 Zou ..... 439/699.2
8,070,347 B1 * 12/2011 Lin ..... 362/654
2007/0183153 A1 * 8/2007 Yu ..... 362/252
2008/0143234 A1 * 6/2008 Yu ..... 313/318.08
2009/0021951 A1 * 1/2009 Yu ..... 362/375
2009/0080195 A1 * 3/2009 Huang ..... 362/267
2009/0251923 A1 * 10/2009 Yu ..... 362/653
2010/0073963 A1 * 3/2010 Yu ..... 362/653

* cited by examiner

*Primary Examiner* — Mary Ellen Bowman
(74) *Attorney, Agent, or Firm* — Birch, Stewart, Kolasch & Birch, LLP

(57) ABSTRACT

A decorative lamp, including a lampshade, a luminophor and conductive wires connected with the luminophor. The decorative lamp includes a wire trapper, one end portion is disposed between the conductive wires and a housing with opened inner space. The wire trapper is disposed inside the inner space, the conductive wires extend out of an opened end of the inner space to be connected to an external power supply with one end portion of the wire trapper and an inner wall of the housing defining the inner space press and fix the conductive wires. The lampshade and the housing respectively include structures that cooperate to form a sealing assembly. The decorative lamp may also be modified by replacing the cooperation between the lampshade and the housing by a snap-fit member such that the luminophor extends out of the snap-fit member and forms a tight cooperation with the snap-fit member.

8 Claims, 5 Drawing Sheets

WATERPROOF DECORATIVE LAMP

TECHNICAL FIELD

The present invention relates to a waterproof decorative lamp, in particular a light emitting diode (LED) waterproof decorative lamp.

BACKGROUND ART

The existing decorative lamps generally comprise a lampshade, a light emitting diode, conductive wires and a lamp holder.

For such decorative lamps, one known structure is effectuated by integrated injection molding, i.e. a light emitting diode is disposed in a lampshade in a way such that two leads of the light emitting diode are led out of the lampshade through conductive wires and then the bottom of the lampshade and the connection portion between the conductive wires and the leads are injected with plastics to form a molded lamp holder into which the bottom of the lampshade and two lead-out conductive wires are over-molded, thereby producing the waterproof effect. For decorative lamps with such structure, it is necessary to deliver the bottom of the lampshade, at which a light emitting diode is disposed, to an injection molding machine for thermal injection-molding. As a result, the machining is inconvenient and the LED is easily damaged during heating.

Another known structure is effectuated by an assembled structure, i.e. a LED is mounted using a soft core and inserted into a soft head installed with terminals and conductive wires to form an assembled lamp holder. With this, the machining is quite convenient. For decorative lamps with such structure, there are gaps at a coupling portion between the soft head and the soft core as well as a coupling portion between the soft head and the conductive wires so that it is impossible to be waterproof, causing that the LED leads and the terminals are oxidized to render poor contact.

SUMMARY OF THE INVENTION

The object of the present invention is to provide a waterproof decorative lamp that is conveniently assembled.

In one aspect, there is provided a decorative lamp comprising a lampshade, a luminophor and conductive wires connected with the luminophor; characterized in that, the decorative lamp further comprises: a wire trapper, one end portion of which is disposed between the conductive wires; and a housing with opened inner space, the wire trapper is disposed inside the inner space, the conductive wires extend out of an opened end of the inner space to be connected to an external power supply; wherein said one end portion of the wire trapper and an inner wall of the housing defining the inner space press and fix the conductive wires, and wherein the lampshade and the housing respectively include structures that cooperate to form a sealing assembly.

In another aspect, there is provided a decorate lamp comprising: a snap-fit member having a throughhole, a luminophor, the bottom of the luminophor is disposed in the throughhole, the main body except for the bottom extending out of the snap-fit member; characterized in that, the decorative lamp further comprises: a wire trapper, one end portion of the trapper is disposed between conductive wires to space the conductive wires apart; a housing with an opened inner space for passage of the wire trapper and the conductive wires, the wire trapper is disposed in the inner space, the conductive wires extend out of one end of the inner space to be connected to an external power supply; wherein said one end portion of the wire trapper and the inner wall of the housing defining the inner space press and secure the conductive wires; wherein the snap-fit member and the housing respectively include structures that cooperate to form a seal assembly; and wherein the bottom of the luminophor has a dimension equal to or greater than that of the throughhole of the snap-fit member so as to form a tight cooperation with said throughhole.

With the invention, the lampshade is pressed against the housing. The slots of the wire trapper and the inner hole of the housing work together to presses and secure the conductive wires.

DETAILED DESCRIPTION OF THE EMBODIMENTS

Figure 1:
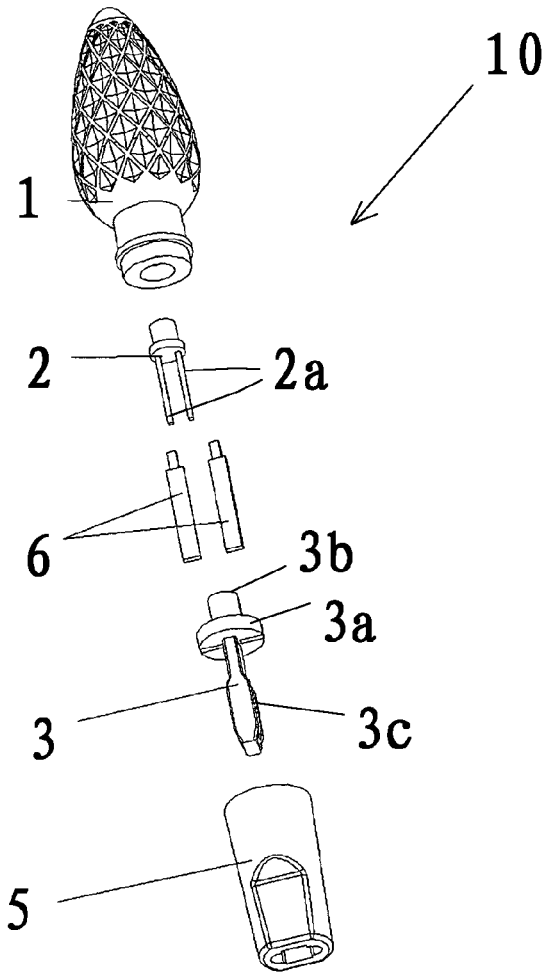
FIG. 1 is an exploded perspective view of the decorative lamp of an embodiment according to the present invention.

Next, the embodiments of the present invention will be described with reference to the drawings, and in the following drawings, the same reference numerals indicate the components having the same functions.

Figure 2:
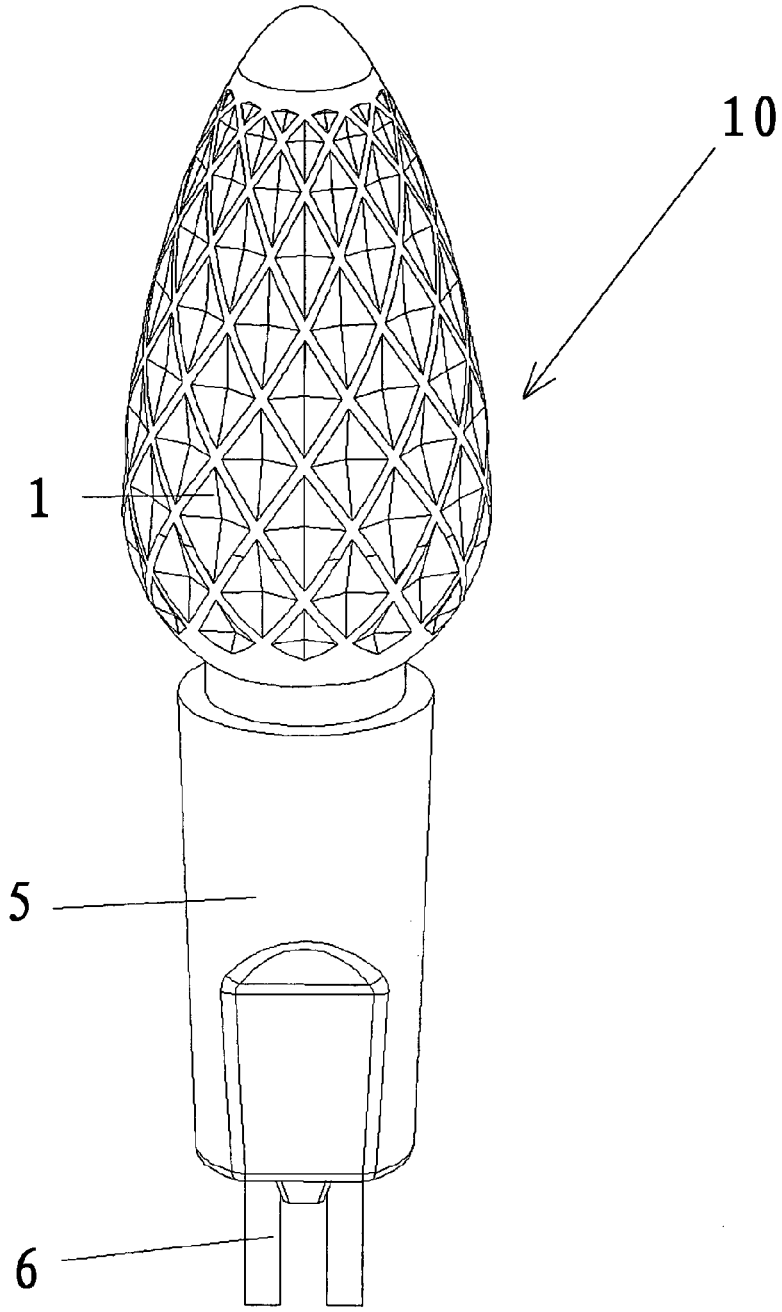
FIG. 2 is an assembled perspective view of the decorative lamp of FIG. 1.

Now the first embodiment according to the present invention is described with reference to FIGS. 1 and 2, in which the decorative lamp as a whole is designated by 10. As shown in FIG. 1, the decorative lamp 10 comprises: a lampshade 1 having a shroud portion and a neck portion; a luminophor 2 such as a light emitting diode, the luminophor 2 having a pin 2*a* for implementing electrical connection; a wire trapper 3; a housing 5 and conductive wires 6.

The pin 2*a* of the luminophor 2 is connected with the conductive wires 6 so as to connect the luminophor 2 with the electrical power of an external power supply. A connecting portion between the luminophor 2 and the conductive wires 6 is trapped by the wire trapper 3. Specifically, the wire trapper 3 includes a platform 3*a* for example in a round shape (which may certainly be in other shapes), a support portion 3*b* extending from a centre of the platform in a direction perpendicular to the platform as well as a partition portion 3*c* extending from the centre of the platform in another direction perpendicular to the platform and opposite to the support portion. The platform 3 has slots penetrating through its entire thickness in opposite directions transverse to the extending direction of the support/partition portion, the slots allow the connecting portion between the luminophor 2 and the conductive wires 6 to pass and be trapped into the slots. Preferably, the slots are formed to the outer periphery of the platform 3*a* to facilitate trapping of said connecting portion. For example, when there are two pins and two conductive wires and the platform is round (i.e. a rounded platform), a pair of radial slots are formed from the support/partition portion to the periphery of the platform in a radially outward direction. Certainly, the numbers of the pins, the conductive wires as well as the radial slots are not limited to two and can be selected based on the practical application requirements. Preferably, the support portion may also be formed with elongate slots that are similar to the aforementioned radial slots so as to accommodate the pin in the slots of the support portion.

The connecting portion between the luminophor 2 and the conductive wires 6 is trapped in the slots of the wire trapper 3, and the support portion 3*b* of the wire trapper 3 is located between the luminophor 2 and the platform 3*a* and rests against the bottom of the luminophor 2 to form a support therefor. The partition portion 3*c* of the wire trapper 3 is located between the conductive wires.

The conductive wires 6 are connected to the luminophor 2 and then pass through the housing 5. After the wires 6 are trapped into the card 3, they are mounted into the housing 5. The space defined by the inner wall of the housing 5 as well as the partition portion 3*b* of the wire trapper 3 is configured so that the inner wall of the housing 5 and the partition portion 3*b* together press and fix the conductive wires 6 when the conductive wires 6 as well as the wire trappers 3 enter the housing. For example, when the housing 5 is substantially cylindrical, the lower end of the housing 5 is pressed in a diametrical direction to reduce the inner space thereof so as to cooperate with the partition portion to press and fix the conductive wires 6.

After the housing 5 is installed, the luminophor 2 is mounted in the shroud portion of the lampshade 1 by passing through the neck portion of the lampshade 1. The neck portion of the lampshade and the housing are provided with cooperating structures that form a sealing engagement therebetween. For example, the external surface of the neck portion of the lampshade is provided with a projected ring, while the inner wall of the housing is provided with a recessed groove; or the inner wall of the housing is provided with a projected ring while the external surface of the neck portion of the lampshade is provided with a recessed groove. Preferably, the external surface of the neck portion of the lampshade and the inner wall of the housing are respectively provided with cooperating threads so as to effectuate a sealing engagement by screwing the neck portion of the lampshade and the housing together. For example, the external surface of the neck portion of the lampshade is provided with male or female threads, and the inner wall of the housing is provided with the cooperating female or male threads.

Figure 3:
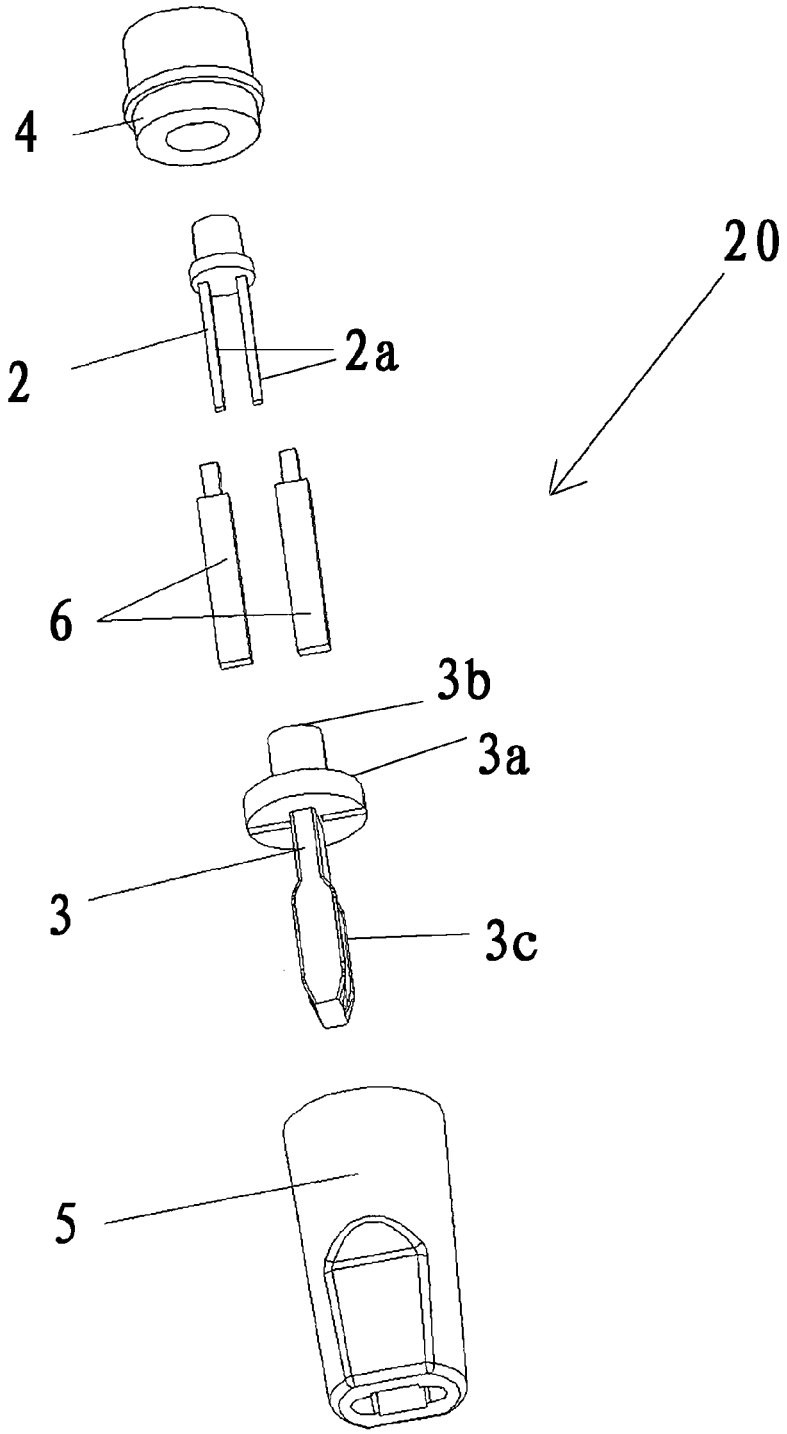
FIG. 3 is an exploded perspective view of the decorative lamp of another embodiment according to the present invention.
Figure 4:
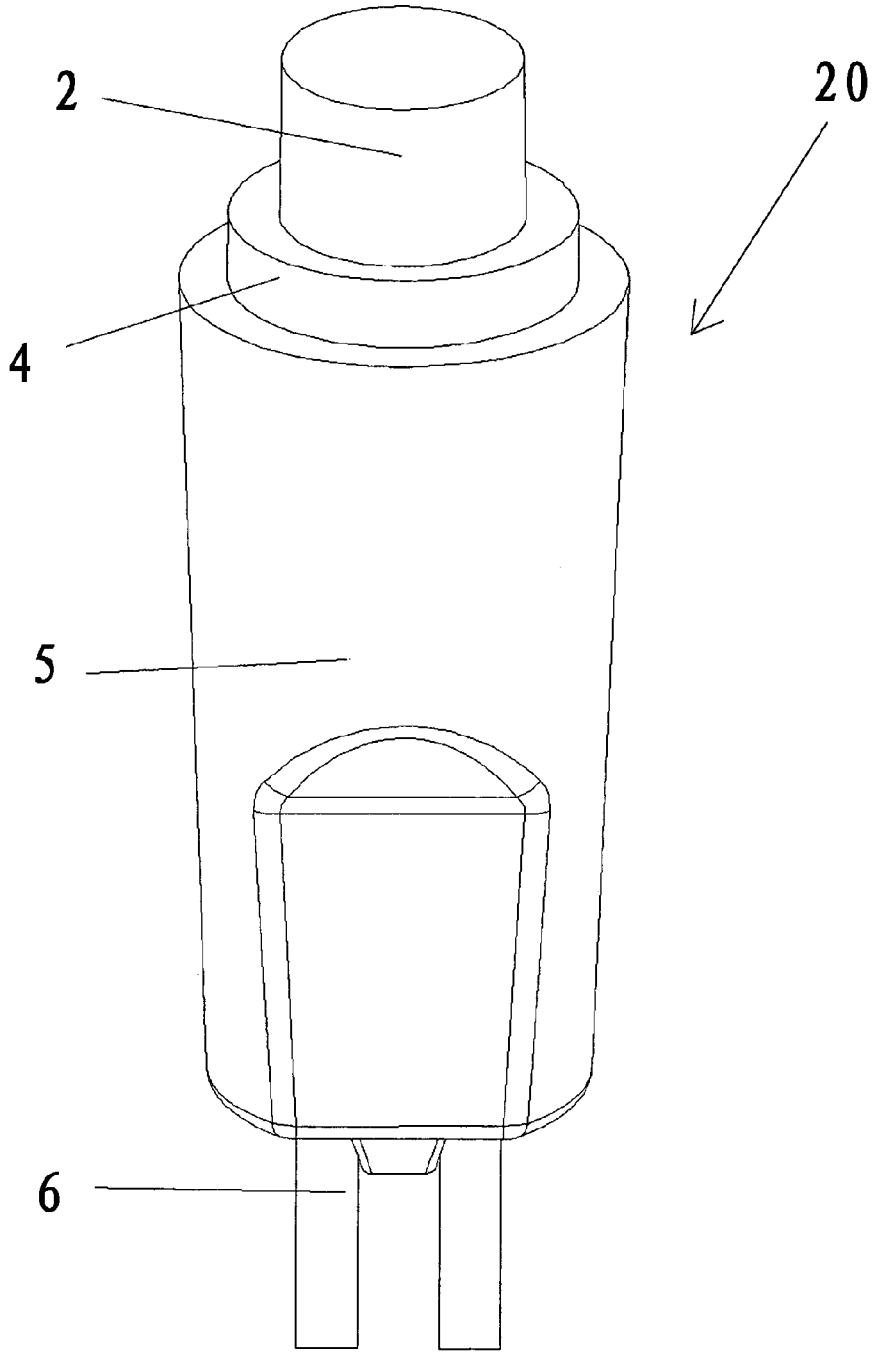
FIG. 4 is an assembled perspective view of the decorative lamp of FIG. 3.
Figure 5:
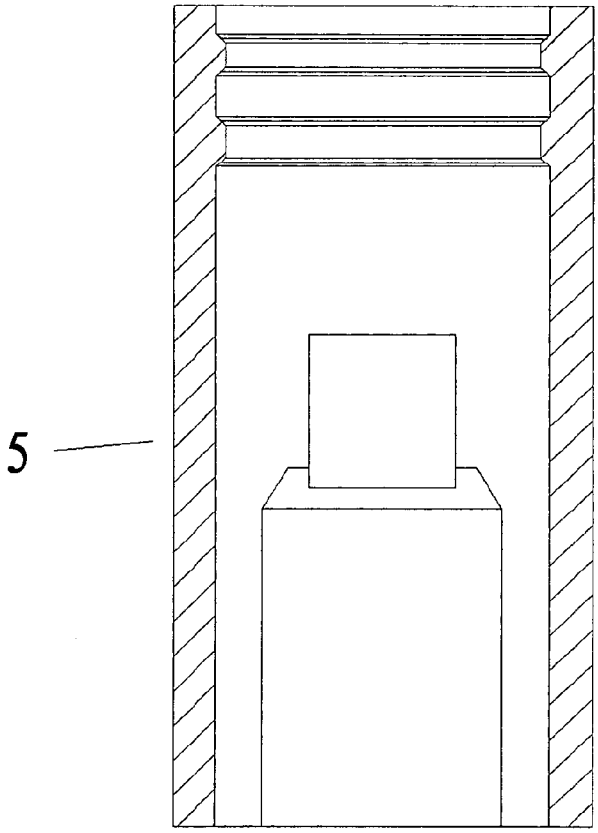
FIG. 5 is a sectional view of the housing of the decorative lamp according to the present invention.

Now the second embodiment according to the present invention will be described with reference to FIGS. 3 and 4. The decorative lamp as a whole is designated by the reference numeral 20 and comprises a snap-fit member 4, a luminophor 2, a wire trapper 3, a housing 5 and conductive wires 6. The structures as well as assembling relations of the luminophor, the wire trapper, the housing and the conductive wires in the second embodiment are similar to those in the first embodiment and the description thereof is omitted.

Similarly to the first embodiment, the conductive wires 6 are connected with the luminophor 2, and then the conductive wires 6 and the luminophor 2 pass through the housing 5 and are trapped into the wire trapper 3 to allow that the wire trapper 3, the conductive wires 6 and the housing 5 is tightly assembled.

Differently from the first embodiment, the luminophor 2 is not accommodated in the lampshade. Instead, the main body of the luminophor 2 extends out of a throughhole formed in the snap-fit member 4, is exposed outside and the snap-fit member 4 is mounted around the bottom of the luminophor 2 like a sleeve. Preferably, the throughhole of the snap-fit member 4 has a dimension equal to or slightly smaller than the outer size of the luminophor 2 so that the bottom of the luminophor 2 is mounted in and seals against the inner passage of the snap-fit member 4 after the main body of the luminophor 2 extends out of the snap-fit member 4.

The snap-fit member 4 and the housing 5 are respectively provided with structures for forming a sealing cooperation so that the housing 5 and the snap-fit member 4 are sealingly mounted together to form a complete waterproof decorative lamp. Likewise, the external surface of the snap-fit member 4 may be provided with a convex ring, while the inner wall of the housing is provided with a cooperating groove; or the inner wall of the housing is provided with a convex ring while the external surface of the snap-fit member 4 is provided with a cooperating groove. Preferably, the external surface of the snap-fit member 4 and the inner wall of the housing are respectively provided with cooperating threads so as to effectuate a sealing cooperation by screwing the snap-fit member and the housing together.

The demonstrative embodiments of the present invention have been described as above, and it should be understood that, the present invention is not limited to details of the aforementioned embodiments, for example, there are no particular constraints/limitations on the materials, shapes and dimensions of various components, as far as the aforementioned structures as well as assembling relations can be realized. Various changes and modifications may be made in the case where the spirit and scope of the present invention are not betrayed.

What is claimed is:

1. An assembly for a decorative lamp, comprising a luminophor;

conductive wires connected with the luminophor; and a wire trapper configured to capture the connections between the conductive wires and the luminophor, wherein one end portion of the wire trapper is disposed between the conductive wires to space the conductive wires apart, and the other end portion supports the luminophor;

an integrally-formed housing with opened inner space, wherein the wire trapper and the conductive wires are inserted into the inner space, the inner space narrowing from an opened end of the inner space for inserting the wire trapper and the conductive wires toward the other opened end of the inner space in a direction of inserting the wire trapper and the conductive wires, and the conductive wires extend out of the other opened end of the inner space to be connected to an external power supply;

wherein said wire trapper includes a platform, a support portion extending from the centre of the platform in a direction perpendicular to the platform as well as a partition portion extending from the centre of the platform in a direction perpendicular to the platform and opposite to the support portion, wherein said one end portion of said wire trapper is said partition portion, and said other end portion of said wire trapper is said support portion;

wherein said platform has slots penetrating through its entire thickness in opposite directions transverse to the extending direction of the support/partition portion, the slots allowing passage and trapping of the connecting portion between the luminophor and the conductive wires; and wherein said partition portion of the wire trapper and the inner wall of the housing defining the inner space, press and fix the conductive wires after the wire trapper and the conductive wires are inserted into the inner space.

2. The assembly according to claim 1, wherein said luminophor is a light emitting diode (LED).

3. The assembly according to claim 1, wherein said luminophor includes pins for connection with the conductive wires.

4. The assembly according to claim 1, wherein said platform is a round platform, said slots are opened from the position on the platform, at which the support/partition portion is located, in a radially outward direction to the periphery of the platform.

5. The assembly according to claim 1, wherein the assembly is mounted to a lampshade to form a decorative lamp, wherein the lampshade and the housing include structures that cooperate to form a sealing assembly.

6. The assembly according to claim 5, wherein said structures includes a male cooperating structure and a female cooperating structure.

7. The assembly according to claim 1, wherein the assembly is mounted to a snap-fit member having a throughhole to form a decorative lamp, wherein the snap-fit member and the housing include structures that cooperate to form a sealing assembly;

wherein the bottom of the luminophor is inserted into the through hole, and the main body of the luminophor is exposed, the snap-fit member is mounted around the bottom of the luminophor like a sleeve; and wherein the bottom of the luminophor has a dimension equal to or greater than that of the throughhole of the snap-fit member so as to form a tight cooperation with said throughhole.

8. The assembly according to claim 7, wherein said structures includes a male cooperating structure and a female cooperating structure.

* * * * *